US006602133B2

(12) United States Patent
Chan

(10) Patent No.: US 6,602,133 B2
(45) Date of Patent: Aug. 5, 2003

(54) INTERACTIVE ELECTRONIC PUZZLE GAME AND A METHOD FOR PROVIDING THE SAME

(75) Inventor: Michael G Chan, Wesley Hills, NY (US)

(73) Assignee: Hearst Holdings, Inc., New York, NY (US)

( * ) Notice: Subject to any disclaimer, the term of this patent is extended or adjusted under 35 U.S.C. 154(b) by 34 days.

(21) Appl. No.: 09/962,501

(22) Filed: Sep. 25, 2001

(65) Prior Publication Data

US 2003/0060250 A1 Mar. 27, 2003

(51) Int. Cl.[7] ..... A63F 13/00

(52) U.S. Cl. ..... 463/9; 463/10; 273/153 R; 273/272

(58) Field of Search ..... 434/335, 322; 463/9, 10; 273/153 R, 272, 429, 459–461

(56) References Cited

U.S. PATENT DOCUMENTS 4,809,979 A * 3/1989 Skowronski et al. ..... 463/9
4,961,579 A * 10/1990 Thompson et al. ..... 273/153 R
5,178,545 A * 1/1993 Thompson ..... 434/335
5,667,438 A 9/1997 Rehm
5,921,864 A * 7/1999 Walker et al. ..... 463/9
6,322,074 B1 * 11/2001 Forrest et al. ..... 273/272
6,340,159 B1 * 1/2002 Giangrante ..... 273/272

* cited by examiner

*Primary Examiner*—Valencia Martin-Wallace
*Assistant Examiner*—Yveste Cherubin
(74) *Attorney, Agent, or Firm*—Ostrolenk, Faber, Gerb & Soffen, LLP

(57) ABSTRACT

A system and method which provides an interactive electronic puzzle game and rearranges that same puzzle after a certain amount of time has elapsed and the player has not performed a specific action required by the game. The interactive puzzle game comprises a player interface module, a player monitoring module connected to the player interface module and operable to detect actions of the player, a puzzle generation module that generates an electronic word-search puzzle, a clock module that sets a specific amount of time and a display module connected to the player interface module and operable to display the electronic puzzle to the player. If the player does not perform a specific action required by the game within an allotted amount of time, the puzzle generation module rearranges the electronic puzzle and the display module displays the rearranged electronic puzzle to the player for continued play. When the puzzle is rearranged, the amount of time is reset, the clock is restarted and the process of rearranging the puzzle is repeated until the puzzle is solved or the player ends the game.

66 Claims, 7 Drawing Sheets

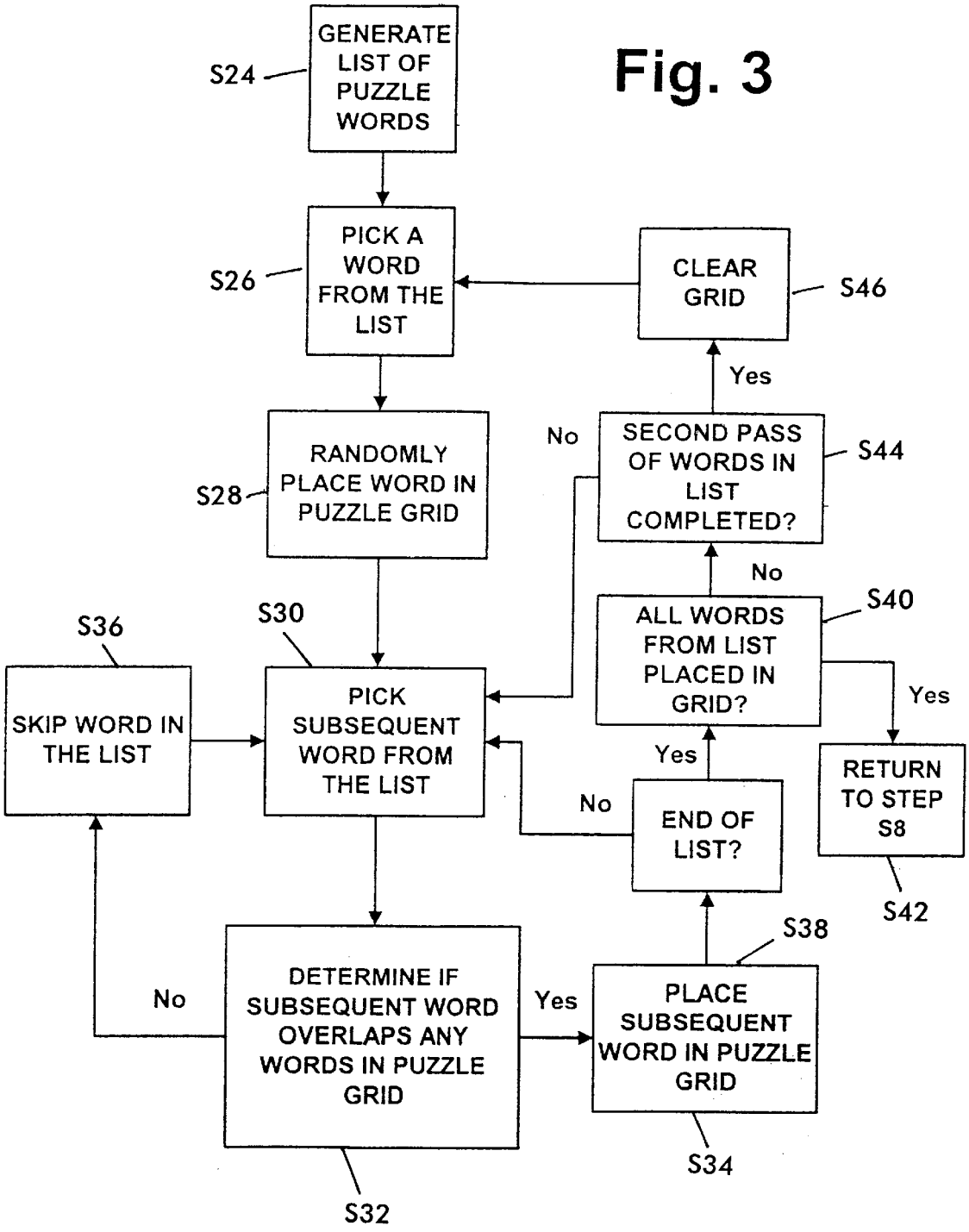
Fig. 3
S24
GENERATE LIST OF PUZZLE WORDS
S26
PICK A WORD FROM THE LIST
S28
RANDOMLY PLACE WORD IN PUZZLE GRID
S30
PICK SUBSEQUENT WORD FROM THE LIST
S36
SKIP WORD IN THE LIST
S32
DETERMINE IF SUBSEQUENT WORD OVERLAPS ANY WORDS IN PUZZLE GRID
No
Yes
S34
PLACE SUBSEQUENT WORD IN PUZZLE GRID
S38
END OF LIST?
No
Yes
S40
ALL WORDS FROM LIST PLACED IN GRID?
Yes
No
S42
RETURN TO STEP S8
S44
SECOND PASS OF WORDS IN LIST COMPLETED?
No
Yes
S46
CLEAR GRID

INTERACTIVE ELECTRONIC PUZZLE GAME AND A METHOD FOR PROVIDING THE SAME

FIELD OF THE INVENTION

The present invention relates to an electronic puzzle game. More particularly, the present invention relates to an electronic word puzzle game where a player attempts to find words from a list within a puzzle grid before a set amount of time elapses and the puzzle grid is rearranged.

BACKGROUND OF THE INVENTION

Traditional printed word-search puzzle games are known and are commonly provided in the Sunday newspaper and puzzle books, for example. In these printed word-search games, the player is provided with a list of words which are to be found in a puzzle grid containing letters. The words in the puzzle grid are arranged randomly and are typically arranged forwards, backward, up, down and/or diagonally.

An electronic version of a universal word search game can be found at UCLICK.COM. This is a Java-based puzzle that challenges a player to find hidden words. There are two versions to this electronic game, a Regular version and a Master version.

The Regular game displays a grid of letters on the player's display device. The game also provides a list of the words the player needs to find in the scramble of letters contained in the puzzle grid. The words may be spelled forward, backwards, up, down or diagonally. To select a word in the grid, the player clicks and holds the mouse on the first letter and drags the cursor across the screen to the end of the word. If the word is one in the list, a red circle remains around the successfully-discovered word. A line appears through the discovered word in the list of words.

In the Master version, the list of words is not displayed to the player and only the number of words and the theme of the puzzle are given as clues to the words to be discovered within the puzzle. As with the Regular version, a red circle remains around successfully-discovered words.

In both versions, if the player gets stumped, they can click on the "Solve Puzzle" to have the computer find and circle the remaining undiscovered words. When the puzzle is completed by finding all of the words, the time the player took to solve the puzzle is displayed, along with how many words the player discovered on their own. Further, there is a "Scramble" button, which, if clicked on by the player, simply re-generates the puzzle without retaining the successfully-discovered words.

Although this prior art electronic puzzle provides a challenge for the players, it simply provides the same functions and challenges as the printed version word search puzzle. Accordingly, this electronic puzzle version of the traditional word search game has failed to provide a game which is different from that of the traditional versions previously provided in the Sunday newspaper and puzzle books.

SUMMARY OF THE INVENTION

The present invention provides an electronic puzzle and rearranges that same puzzle after a certain amount of time has elapsed and the player has not performed a specific action required by the game. The interactive puzzle game comprises a player interface module, a player monitoring module connected to the player interface module and operable to detect actions of the player, a puzzle generation module that generates an electronic word-search puzzle, a clock module that sets a specific amount of time and a display module connected to the player interface module and operable to display the electronic puzzle and clock to the player. If the player does not perform a specific action required by the game within an allotted amount of time as measured by the clock module, the puzzle generation module rearranges the electronic puzzle and the display module displays the rearranged electronic puzzle to the player for continued play. When the puzzle is rearranged, the amount of time is reset, the clock is restarted and the process of rearranging the puzzle is repeated until the puzzle is solved or the player ends the game.

In the preferred embodiment, the electronic puzzle is in the form of a puzzle grid and is generated by (a) generating a list of puzzle words; (b) randomly selecting a word from the list of puzzle words; (c) randomly placing the word in the puzzle grid; (d) selecting a subsequent word from the list of puzzle words; (e) determining if any of the letters in the subsequent word overlap any of the letters in any word within the puzzle grid; (f) placing the subsequent word in the puzzle grid if the letters of the subsequent word overlap any of the letters in any word within the puzzle grid; and (g) skipping the subsequent word if the subsequent word does not overlap any word within the puzzle grid. Steps (d) through (g) are preferably repeated until all words in the list of puzzle words are placed in the puzzle grid.

Also in the preferred embodiment, the electronic puzzle is rearranged by repeating steps (b) through (g) that were used to generate the electronic puzzle until all words are placed in the puzzle grid.

The implementation of an electronic word search puzzle which spontaneously rearranges itself upon the reaching of a time limit provides an increased level of challenge which is not achieved by previous word search puzzles.

BRIEF DESCRIPTION OF THE DRAWINGS

Other features and advantages of the present invention will become apparent from the following description of the invention which refers to the accompanying drawings in which:

FIG. 3 is a flow chart illustrating the preferred method used to generate the electronic puzzle;

DETAILED DESCRIPTION OF EMBODIMENTS OF THE INVENTION

The present invention will be described herein as implemented as a word-search puzzle. It will be apparent, however, that the present invention can be used with electronic versions of other word and similar word-type games, such as crosswords, jumbles, etc. Preferably, the present invention is an Internet hosted game, written in Java script. However, it will be evident from the detailed description provided herein, that the present invention can be embodied, for example, in a stand alone game console, a downloadable game for a personal digital assistant (PDA), cell phone, personal computer or a cartridge based game for a portable or similar game system which utilizes interchangeable game cartridges, such as the NINTENDO GAMEBOY®.

Figure 1:
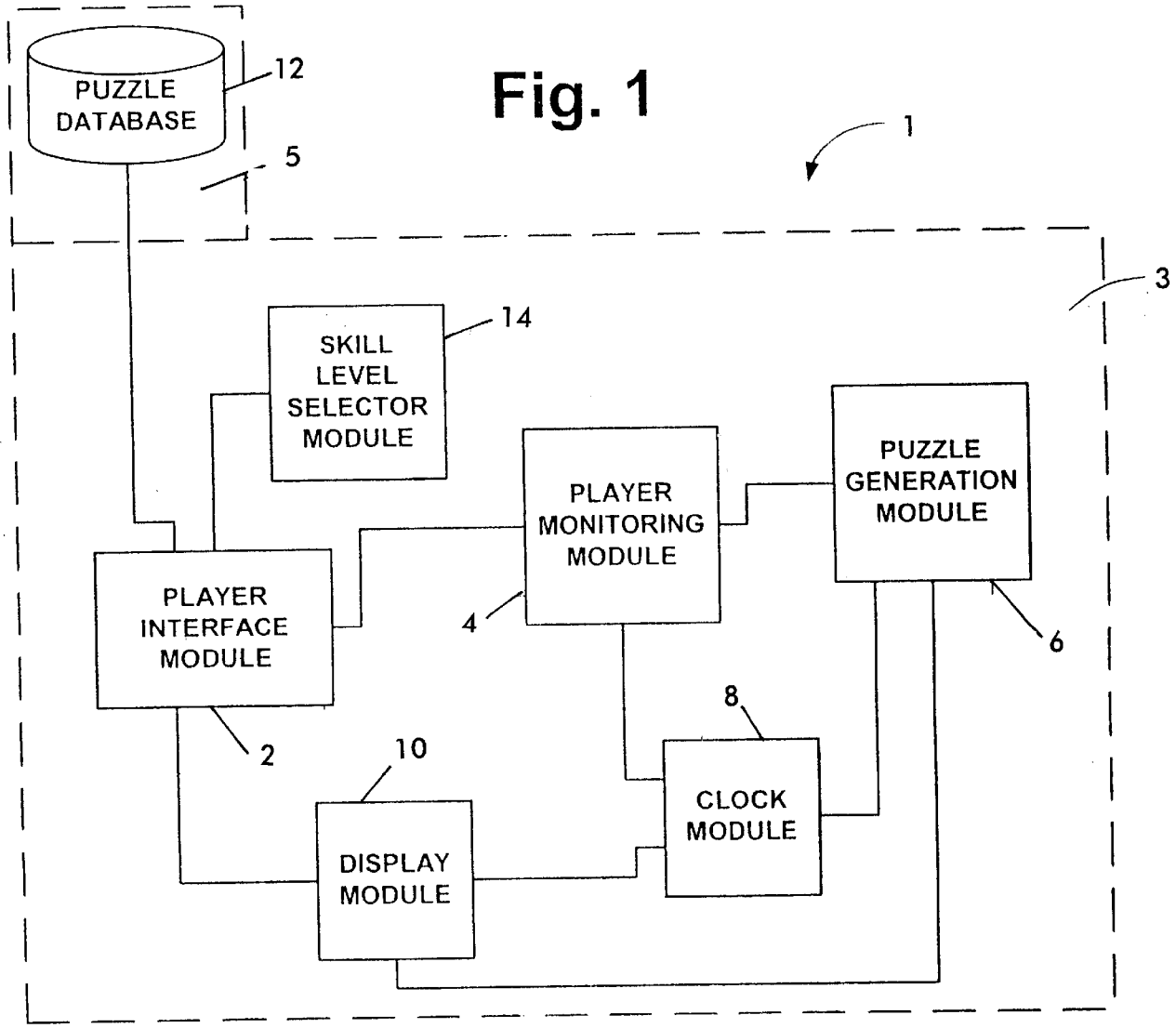
FIG. 1 is a block diagram of an interactive puzzle system in accordance with the present invention.

Referring now to the drawings, FIG. 1 shows a first embodiment of the system according to the present invention, generally referred to as 1. The system comprises a player interface module 2, a player monitoring module 4 connected to the player interface module 2 and operable to detect actions of the player, a puzzle generation module 6 that generates an electronic word-search puzzle, a clock module 8 that sets a specific amount of time and a display module 10 connected to the player interface module 2 and operable to display the electronic puzzle to the player. The modules of the present invention are preferably implemented as portions of a computer program executing on a processor 3. Processor 3 contains well known components (not shown) such as a CPU, RAM, ROM, I/O, etc., which will not be described in detail herein. Preferably, the computer program is a Java based program which is adapted for use on a standard personal computer over the Internet, but can be in any other suitable format, such as a format suitable for use within a PDA.

The system 1 may also include a database 12 connected to the player interface module 2. In the preferred Internet hosted game, the database 12 is at the server. The database 12 preferably contains a plurality of word-search puzzles that are selectable by the player. The database 12, however, may also contain different types of puzzles. When the player selects a specific puzzle from the database 12, the puzzle generation module 6 generates an electronic puzzle that corresponds to the puzzle selected by the player. As shown in FIG. 1, the database 12 may be located in a separate memory 5. The system 1 may also include a skill level selector module 14 connected to the player interface module 2. The skill level selector module 14 provides the player with a choice of different skill levels for the puzzle game to be played.

Figure 2:
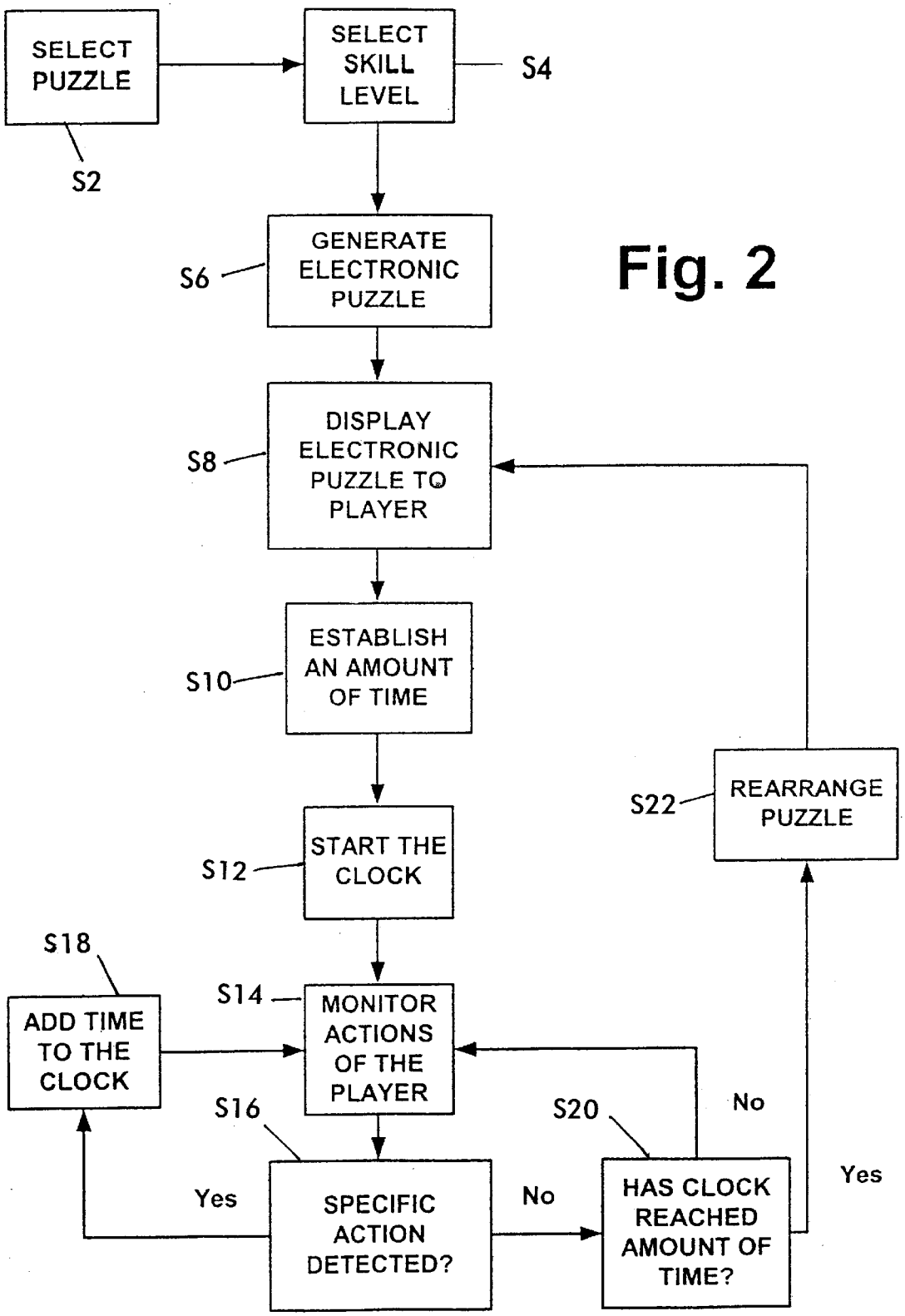
FIG. 2 is a flow chart illustrating the preferred method used to generate and interact with the electronic puzzle of the present invention.

FIG. 2 illustrates the preferred method used to generate and interact with the electronic puzzle. In the preferred steps of FIG. 2, when a player wishes to play the electronic puzzle game according to the present invention, the player first selects a word-search puzzle from the database 12 at step S2. Then, at step S4, the player selects the skill level at which to play the game. The skill levels may be such levels a beginner, intermediate or expert, or any similar type level designation.

In response to the selection of the puzzle and skill level by the player, the puzzle generation module 6 generates the electronic word-search puzzle at step S6. Preferably, the electronic word-search puzzle is in the form of a puzzle grid having a plurality of columns and rows which intersect to define a location for a letter. The electronic puzzle, however, can take other forms as dictated by the particular game to be played.

FIG. 3 illustrates the preferred method of Step 6 (FIG. 2) used to generate the electronic puzzle. As shown in FIG. 3, to generate the electronic word-search puzzle, the puzzle generation module 6 first retrieves a list of puzzle words from the database 12 (Step S24). Alternatively, the list of puzzle words can be generated by the puzzle generation module 6 itself or by the player.

In Step S26, the puzzle generation module 6 selects a first word from the list of puzzle words. Preferably, the puzzle generation module 6 randomly selects this first word from any of the words in the list. However, the first word selected can simply be the first word in the list.

In Step S28, the puzzle generation module 6 randomly places the first word in the puzzle grid. The words can be placed in the puzzle grid by the puzzle generation module 6 either vertically, horizontally or diagonally and can arrange the words forwards or backwards. After the first word is placed in the puzzle grid, that word is tagged in the list of puzzle words as having been used in the puzzle grid.

Next, in Step S30, the puzzle generation module 6 selects a subsequent word from the list of puzzle words and determines in Step S32 if any of the letters in the subsequent word overlap any of the letters of the first word placed in the puzzle grid. In one embodiment, the subsequent word selected is the next word in the list of puzzle words. By "selection", it is contemplated that the puzzle generation module 6 creates a copy of the selected word from the list. If any of the letters of the subsequent word overlap any of the letters in the first word within the puzzle grid, then the puzzle generation module 6 places the subsequent word in the puzzle grid (Step S34). In other words, if any letter of the subsequent word is the same as a letter in the first word placed in the puzzle grid, the puzzle generation module 6 places the subsequent word within the grid such that those letters overlap each other. When the subsequent word is placed in the puzzle grid, that subsequent word is then tagged in the list of puzzle words as having been used in the puzzle. If any of the letters of the subsequent word do not overlap with the letters of the first word in the puzzle grid, then the puzzle generation module 6 skips that subsequent word (Step S36).

After the subsequent word is either placed within the puzzle grid or skipped, the puzzle generation module 6 in Step S30 selects a next subsequent word for placement within the puzzle grid. When placing this next subsequent word within the puzzle grid, the puzzle generation module 6 operates to determine if any of the letters of the next subsequent word overlap any of the letters of words already placed within the grid (Step S32). Similar to that described above, if the next subsequent word does not overlap any word or the previously placed word within the puzzle grid, then the next subsequent word is skipped (Step S36).

Preferably, after the puzzle generation module 6 randomly selects the first word from the list of puzzle words and places that first word within the puzzle grid, the puzzle generation module 6 then selects the words in order from the beginning of the list of puzzle words and attempts to place each of the words within the puzzle grid. If any of the letters in a selected word overlap any letters of a word within the puzzle grid, then that selected word is placed in the puzzle grid (Step S34) and is tagged in the list of puzzle words as having been used. If the selected word does not overlap a word within the puzzle grid, then that word is skipped (Step S36) and the next word in order from the beginning of the list of puzzle words is selected for placement (Step S30).

After the puzzle generation module 6 places a word in the puzzle grid (Step S34), the puzzle generation module 6 determines if the end of the list of puzzle words has been reached (Step S38). If the end of the list has not been reached, then the puzzle generation module 6 returns to Step S30 and selects the next word in the list of puzzle words for placement in the puzzle grid.

If the end of the list has been reached, then the puzzle generation module 6 determines, at Step S40, whether all the words from the list of puzzle words have been placed in the puzzle grid. If all the words have been used, then the puzzle generation module 6 returns to Step S8 of FIG. 2. If any of the words were previously skipped in Step S36, then the puzzle generation module 6 performs a second pass of the words in the list of puzzle words and attempts to place the skipped words in the puzzle grid similar to that described above for placement of the subsequent words within the puzzle grid. If, at Step S44, the second pass has already been completed and all words from the list of puzzle words are still not placed in the puzzle grid, then the puzzle generation module 6 preferably clears the puzzle grid at Step S46 and starts the placement process over at Step S26. This process is preferably repeated until a completed puzzle grid is generated by the puzzle generation module 6.

In an alternative embodiment for placing words in the puzzle grid (Step S32), the puzzle generation module 6 can select the words from the list of words and simply place each one in the puzzle grid without an overlap between words, or can place the words in the puzzle grid as a combination of overlapped and non-overlapped words.

In another alternative embodiment, the puzzle generation module 6 may select a previously skipped word after placement of any subsequent word within the grid to determine if that previously skipped word overlaps the most recently placed word in the grid. In other words, each time a word is placed within the grid, the puzzle generation module 6 may select a previously skipped word which was not placed in the grid, as opposed to selecting the next word in order in the list. If there is more than one skipped word, then the puzzle generation module 6 may select the oldest skipped word for placement.

Figure 4:
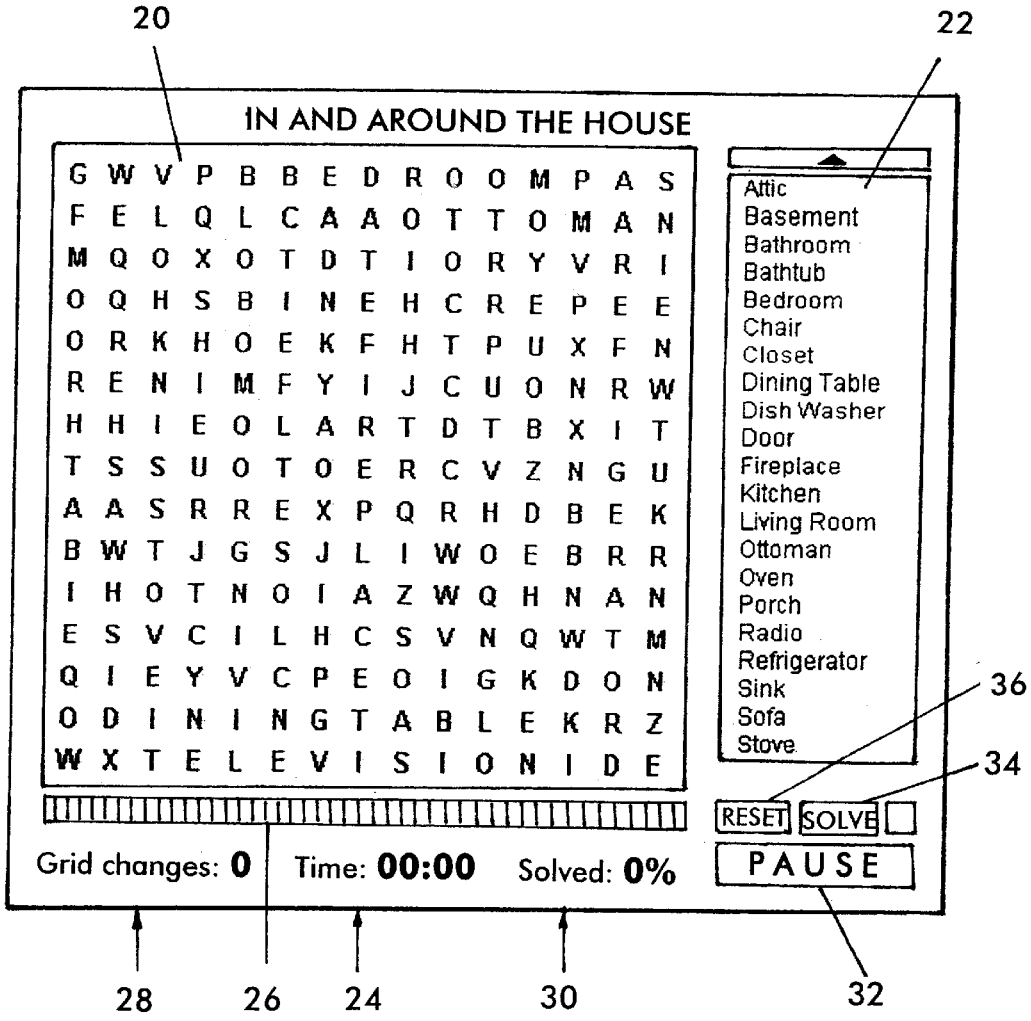
FIG. 4 is an illustration of the preferred layout of the electronic puzzle in accordance with the present invention.

After all words from the list have been placed in the puzzle grid, the remaining spaces in the grid are randomly filled with letters. A completed puzzle grid 20 is illustrated in FIG. 4.

Returning to FIG. 2, the electronic puzzle generated by the puzzle generation module 6 in Step S6 is displayed to the player at Step S8 by the display module 10. Also, depending upon the game selected by the player and/or the skill level selected, the list of words 22 (FIG. 4) which are to be identified within the electronic puzzle grid 20 (FIG. 4) are also displayed to the player by the display module 10.

After the electronic puzzle is displayed to the player, the clock module 8 establishes an amount of time at step S10. As further described below, the time is established in which the player must find a word or perform other actions depending upon the puzzle selected by the player. The amount of time established will depend upon the game and/or skill level selected by the player. For example, the amount of time established would be greater for a beginner skill level as compared to an expert skill level. Preferably, for example, the amount of time established is 30 seconds for the beginner level, 25 seconds for the intermediate level and 20 seconds for the expert level. Once the amount of time is established by the clock module 8, a clock is started at step S12 in response to a command from the player to start play of the game.

Figure 5:
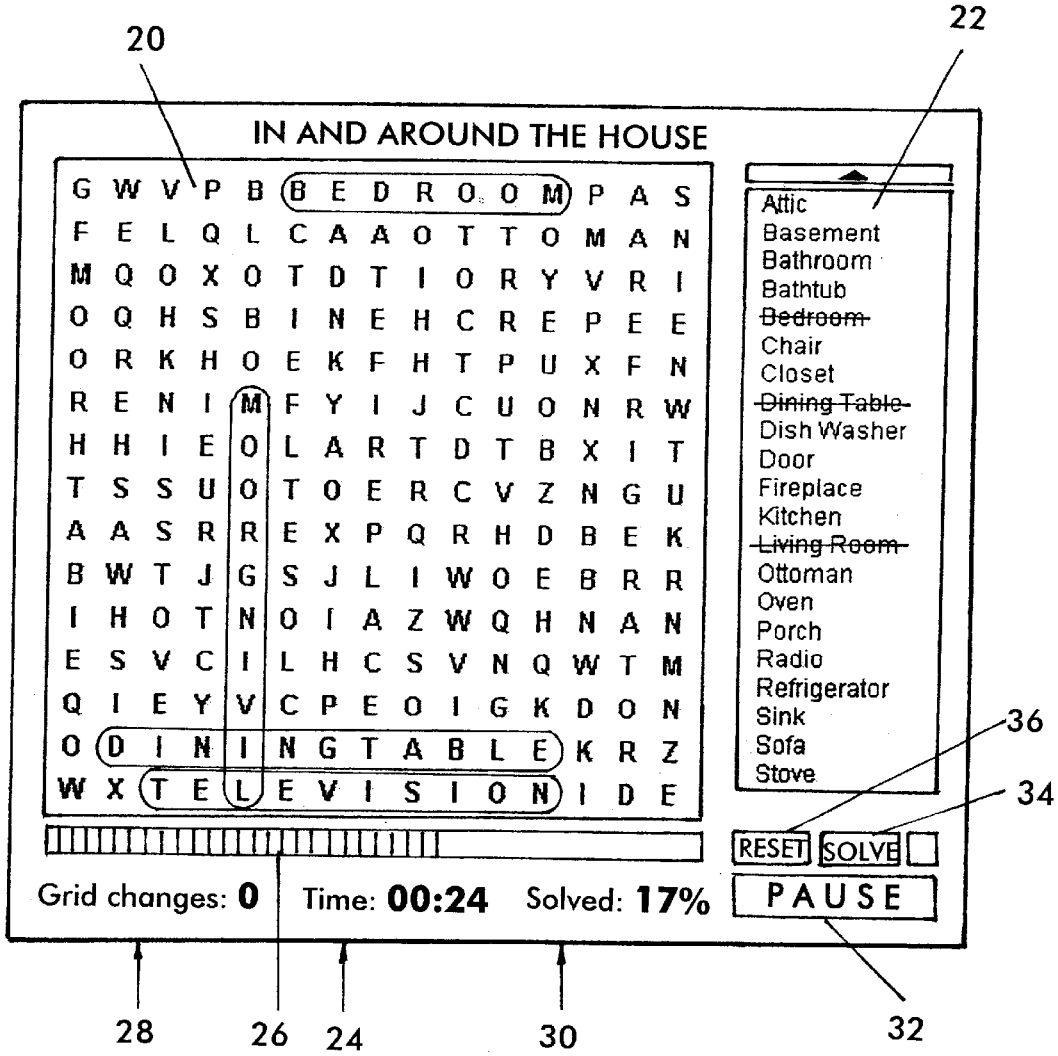
FIG. 5 is an illustration of the electronic puzzle of FIG. 4 with words identified within the puzzle grid.

In the word-search puzzle according to the preferred embodiment described herein, the player is prompted to search for and identify words within the puzzle grid that correspond to the words within the list. However, depending upon the skill level selected by the player, the list may not be displayed and clues, or no clues, may be provided as to the words that are to be identified. The player interface module 2 is operable to allow the player to interact with the puzzle grid to identify the words contained therein. The player monitoring module 4 monitors the actions of the player during the game, and identifies whether or not the player has performed the specific actions required by the game, e.g., identification of a word within the puzzle grid which is in the list of words. FIG. 5 illustrates the puzzle grid 20 having words from the list identified therein.

While the player is trying to identify words within the puzzle grid that correspond to words within the list, the clock module 8 (FIG. 1) is counting towards the amount of time established at the start of the game. Preferably, the display module 10 also displays to the player the clock 24 (FIG. 4) and the amount of time remaining 26 (FIG. 4) until reaching the established amount of time. As stated above, the player monitoring module 4 (FIG. 1) monitors the actions of the player and detects a specific action (Steps S14 and S16), i.e., the identification of a word in the puzzle grid that corresponds to a word in the list. If the player monitoring module 4 detects that the player has performed the specific action required by the game at Step S16, then time is preferably added to the clock at Step S18. This feature of decrementing a clock and adding time to the clock in response to the identification of a word in the puzzle grid 20 provides a new dimension to the puzzle game which cannot be achieved with traditional printed versions, and is not contemplated by the prior art electronic versions. The amount of time added can vary depending upon the game and/or skill level selected by the player. For example, 15 seconds may be added to the clock for the beginner level, 10 seconds for the intermediate level and 5 seconds for the expert level.

If the player monitoring module 4 does not detect the specific action required by the game at Step S16, and the clock has reached the established amount of time at Step S20, the puzzle generation module 6 (FIG. 1) rearranges the electronic puzzle at Step S22. While the electronic puzzle is being rearranged, play is suspended. After the puzzle has been rearranged, the rearranged puzzle is then displayed to the player by the display module 10 at Step S8. If there have been any words identified by the player and marked in the puzzle grid, these words are also marked in the rearranged puzzle. An example of the displayed rearranged puzzle grid 20, with marked words which were previously identified by the player, is shown in FIG. 6.

The procedure (Step S22) for rearrangement of the puzzle grid 20 by the puzzle generation module 6 is similar to the procedure used to generate the puzzle grid 20 at the beginning of the game as described in relation to FIG. 3, except that the list of words to be placed in the puzzle grid 20 is not generated because the list has already been generated or retrieved from the database 12. As stated above, the steps for rearranging the electronic puzzle include selecting a word from the list of puzzle words, placing the word randomly in the puzzle grid, selecting a subsequent word from the list of puzzle words, determining if any letters in the subsequent word overlap any letters in any words within the puzzle grid, placing the subsequent word in the puzzle grid if the subsequent word overlaps any word within the puzzle grid, and skipping the subsequent word in the list of puzzle words if the subsequent word does not overlap any word within the puzzle grid. The puzzle generation module 6 then repeats these steps until all words in the list of puzzle words are placed in the rearranged puzzle grid. If there are any words remaining from the list which have not been placed in the rearranged puzzle grid after the above process is repeated, then these words can be randomly placed in the grid without overlapping any other words in the grid. After all words from the list have been placed in the rearranged puzzle grid, then the remaining spaces in the grid are again randomly filled with letters.

This feature of rearranging the puzzle grid after a certain amount of time has elapsed further adds to the challenge of this puzzle, cannot be achieved with traditional printed versions, and is not even contemplated by the prior art electronic versions. For example, the player cannot simply sit there and study the puzzle for any great period of time, because if they do, the time period will lapse and the puzzle will be rearranged before their eyes. This feature greatly increases the speed at which the player needs to find the words in the puzzle grid, and provides a greater level of anxiety and challenge during play.

Figure 6:
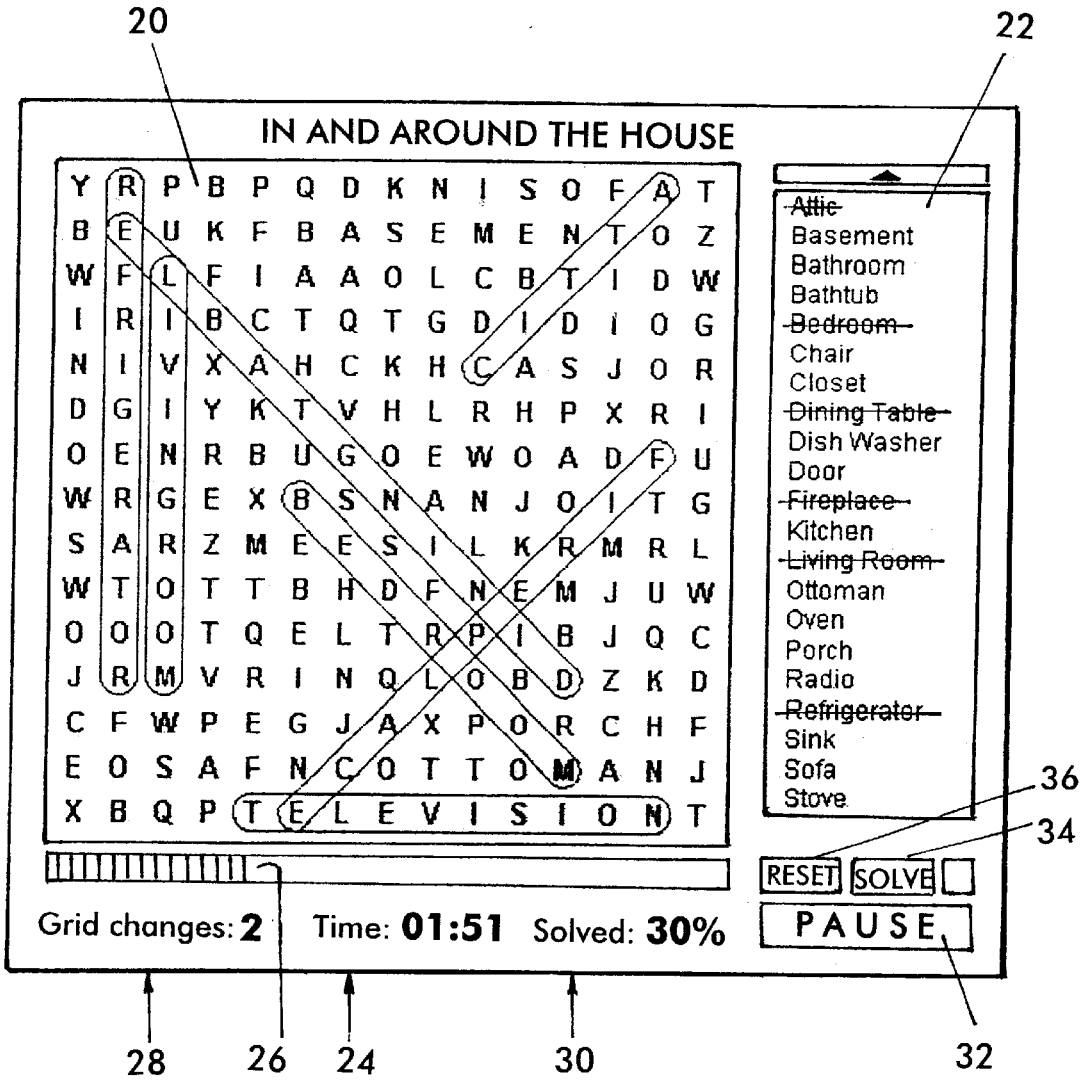
FIG. 6 is an illustration of the electronic puzzle with words marked within the puzzle grid and the list after the grid has been rearranged.

FIG. 6 shows an example of the rearranged puzzle grid 20. Similar to the start of the game, the list of words 22 may be displayed depending upon the skill level selected by the player. As is shown in FIG. 6, the words that were previously identified in the puzzle grid 20 by the player before the clock 26 reached the amount of time are marked in the puzzle grid 20. Also, if the list of words 22 is displayed to the player, the "found" words are also marked therein.

After the puzzle grid 20 has been rearranged, the clock 26 is reset to the established amount of time and the clock 26 is started. As the game continues, the puzzle grid 20 is rearranged each time the clock 26 reaches the established amount of time and the specific action has not been detected until all words within the list 22 are identified by the player within the puzzle grid 20.

In the preferred embodiment of the electronic puzzle game, and as shown in FIGS. 4 and 6, the clock 26 is displayed to the player and the color of the clock 26 is changed in response to the amount of time remaining. For example, if a beginner level starts with 30 seconds on the clock, the clock color is initially displayed using the color green. When there are 15 or less seconds left to find a word within the puzzle grid 20 before the grid is rearranged, the clock color is changed from green to yellow. When there are 5 or less second left to find a word, the clock color is changed from yellow to red. This changing of the clock color allows the player to use their peripheral vision to quickly determine the amount of time remaining until the electronic puzzle is rearranged. This particular method of changing the clock color is but one way to indicate the time remaining to the player. Other ways, such as providing different sounds or other visual means may be implemented.

Figure 7:
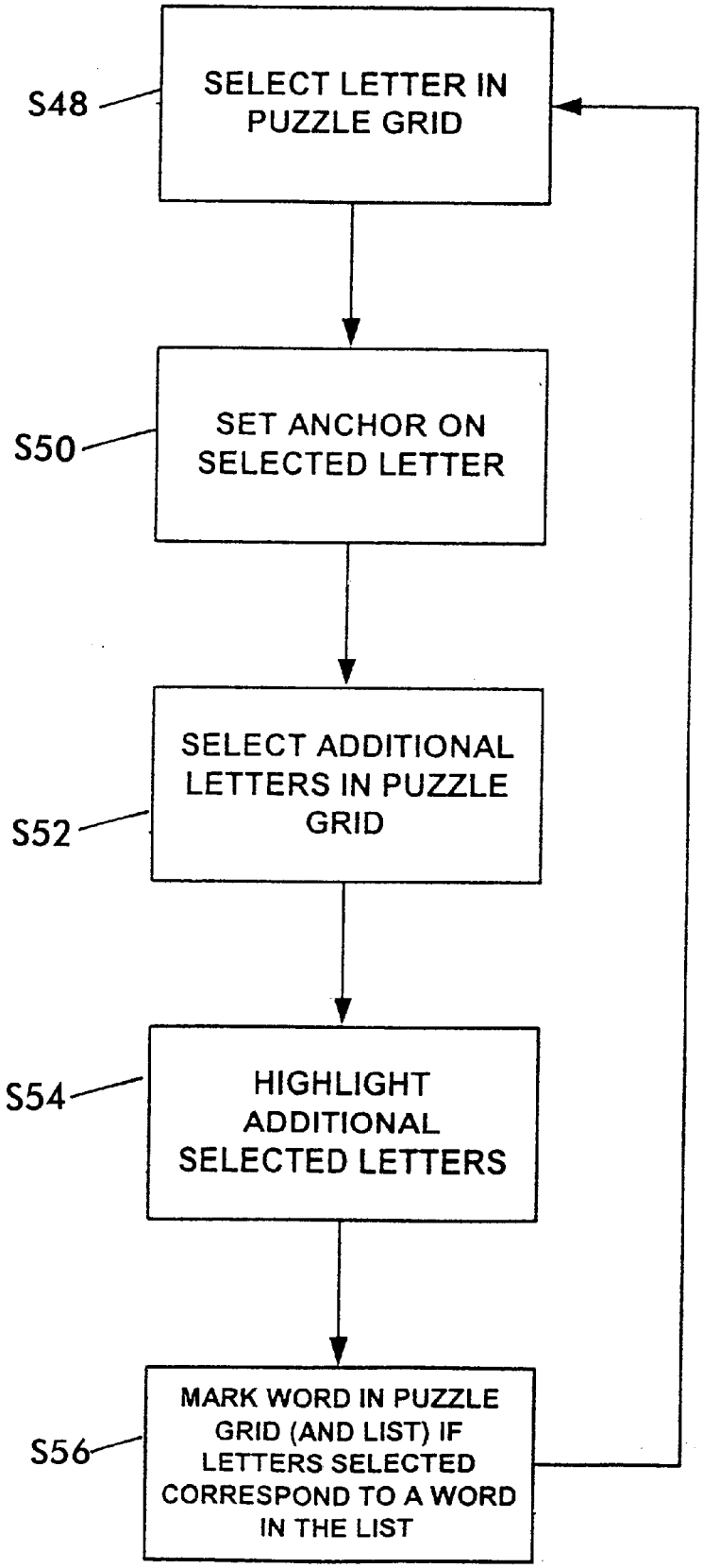
FIG. 7 is a is a flow chart illustrating the preferred method used to select and mark the words within the puzzle grid of the present invention.

FIG. 7 illustrates the preferred steps for identification of the words within the puzzle grid 20 (FIG. 4) by the player. To identify the words within the puzzle grid 20, the player at step S48 must first select a letter within the puzzle grid 20. The selection of the letter may be by pointing to and clicking on the letter with a mouse or keyboard, for example if a personal computer is used to implement the game, or through the use of a stylus and input sensitive screen such as that provided with a PDA. Preferably, when the player selects a letter within the grid 20, the player monitoring module 4 (FIG. 1) at step S50 sets an anchor on the letter selected by the player within the puzzle grid 20. In response to the player dragging either the mouse or stylus across the screen, for example, additional letters are selected by the player at step S52 and highlighted at step S54. In a preferred embodiment, the player does not have to hold down the mouse button once the anchor letter has been selected. Preferably, the letters are highlighted by placing a continuous circle around all of the letters selected by the player, although any other technique can be used to identify the letters to the player. When the player believes the selected, highlighted letters correspond to a word on the list, the player can click on the last highlighted letter with the mouse button if a personal computer is being used or raise the stylus from the screen if a PDA is being used. This described method of highlighting and identifying the words within the grid is but one example of a procedure which can be used. Other variations of the manner in which words can be identified will be evident and can also be used in conjunction with the present invention.

If the letters selected by the player corresponds to a word in the list of words 22 (FIGS. 4–6) to be identified, then that word is marked in the puzzle grid at step S56, preferably by placing a circle around the word. Also, if the game selected by the player has the list of words 22 to be identified displayed to the player, then the identified word is also marked in the list at step S56, preferably by placing a line through the word. See FIG. 5 for an example of the electronic puzzle having words within the puzzle grid and list marked after identification by the player.

Also, and as shown in FIGS. 4–6, the display module 10 (FIG. 1) can display to the player the number of times the puzzle grid has been rearranged 28, a timer 24 showing the total overall time the game has been played before all the words have been identified within the grid 20, and the percentage of the puzzle which has been identified by the player 30. With this, it is possible to keep track of the "high scores" for each game and possibly provide tournaments with prizes for the players having the best times.

Further, the electronic puzzle game can be provided with a pause function 32, shown in FIGS. 4–6. Preferably, this will be provided in the form of a button 32 which the player can select with the mouse or the stylus. Upon selection of the pause button 32, the electronic puzzle grid 20 is preferably hidden from the player and the clock 26 and timer 24 are stopped such that the player cannot continue to solve the puzzle while time is not counted.

Additionally, and similar to the pause function, the electronic puzzle game can be provided with a solve function 34. Preferably, the solve function 34 is also provided in the form of a button for selection by the player. With the selection of the solve button, the puzzle is completed for the player. Also, the electronic puzzle game can include a reset function 36, which resets the puzzle grid 20 and restarts the game.

The interactive electronic puzzle game as described herein, which rearranges itself upon the reaching of a time limit, provides an increased level of challenge for a player which is not capable of being achieved by previous word search puzzles. Specifically, the timed rearranging of the puzzle grid challenges a player to solve the puzzle before time runs out, thereby providing an increased level of difficulty and a new twist on a traditional game. Moreover, with the addition of various visual and/or audio effects, the fun and challenge of the game can be further enhanced beyond that of traditional printed versions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of providing an interactive puzzle game, the method comprising:

generating an electronic puzzle;

displaying the electronic puzzle to a player;

establishing an amount of time;

starting a clock;

monitoring actions of the player;

rearranging the electronic puzzle if the player has not performed a specific action and if the clock has reached the amount of time; and displaying the rearranged electronic puzzle to the player.

2. The method as recited in claim 1, wherein the electronic puzzle is in the form of a puzzle grid and the step of generating the electronic puzzle comprises:

(a) generating a list of puzzle words;

(b) selecting a word from the list of puzzle words;

(c) placing the word randomly in the puzzle grid;

(d) selecting a subsequent word from the list of puzzle words;

(e) determining if a portion of the subsequent word overlaps a portion of any word within the puzzle grid;

(f) placing the subsequent word in the puzzle grid if the subsequent word overlaps any word within the puzzle grid; and (g) skipping the subsequent word in the list of puzzle words if the subsequent word does not overlap any word within the puzzle grid.

3. The method as recited in claim 2, wherein the step of generating the list of puzzle words comprises retrieving a list of puzzle words from a memory.

4. The method as recited in claim 2, wherein the step of generating the electronic puzzle further comprises repeating steps (d) through (g) until all words in the list of puzzle words are placed in the puzzle grid.

5. The method as recited in claim 4, wherein the step of rearranging the electronic puzzle comprises repeating steps (b) through (g) of generating the electronic puzzle until all words are placed in the puzzle grid.

6. The method as recited in claim 2, wherein the words are randomly selected from the list of puzzle words.

7. The method as recited in claim 1, wherein the electronic puzzle is a grid containing letters, the method further comprising prompting the player to search for and identify words within the puzzle grid.

8. The method as recited in claim 7, wherein the words within the puzzle grid are identified by:

setting an anchor in response to the selection of a letter within the puzzle grid by the player; and highlighting additional letters within the puzzle grid in response to the selection of those letters by the player.

9. The method as recited in claim 8, the method further comprising displaying the words within the puzzle grid to the player separate from the puzzle grid.

10. The method as recited in claim 9, further comprising marking a word within the puzzle grid if the letters selected by the player identify a word.

11. The method as recited in claim 10, further comprising marking a word displayed to the player which corresponds to the word marked within the puzzle grid.

12. The method as recited in claim 11, wherein the words identified by the player remain marked within the puzzle grid after the puzzle grid is rearranged.

13. The method as recited in claim 1, the method further comprising adding time to the clock in response to detection of the specific action.

14. The method as recited in claim 1, further comprising prompting the player to select a skill level for the interactive puzzle game.

15. The method as recited in claim 14, further comprising setting the amount of time to different values depending upon the skill level selected by the player.

16. The method as recited in claim 15, wherein the electronic puzzle is in the form of a puzzle grid, the method further comprising adding different amounts of time to the clock depending on the skill level selected by the player if the specific action is detected.

17. The method as recited in claim 1, further comprising:

displaying the clock to the player; and changing colors of the clock in response to the amount of time remaining.

18. The method as recited in claim 1, further comprising resetting the clock in response to the rearranging of the electronic puzzle.

19. The method as recited in claim 1, further comprising hiding the electronic puzzle in response to an indication by the player to pause the game.

20. The method as recited in claim 1, further comprising completing the electronic puzzle in response to an indication by the player to solve the electronic puzzle.

21. The method as recited in claim 1, further comprising keeping track of the number of times the electronic puzzle is rearranged.

22. The method as recited in claim 1, further comprising keeping track of the overall time the interactive puzzle game is played.

23. The method as recited in claim 1, further comprising prompting the player to select a puzzle to be played from a plurality of puzzles, the electronic puzzle generated corresponding to the puzzle selected by the player.

24. A method of providing an interactive puzzle game, the method comprising:

prompting a player to select a puzzle to be played from a plurality of puzzles, each puzzle containing a list of words to be identified by the player;

generating an electronic puzzle grid containing the words from the list of words;

displaying the list of words to be identified and the electronic puzzle grid to the player;

establishing an amount of time;

starting a clock;

prompting a player to find the words in the list within the puzzle grid;

setting an anchor in response to the selection of a letter within the puzzle grid by the player;

highlighting additional letters within the puzzle grid in response to the selection of those letters by the player;

marking the word corresponding to the highlighted letters within the puzzle grid if the letters selected by the player identify a word within the list;

marking the word in the list which corresponds to the word marked within the puzzle grid to indicate that the word has been identified by the player;

adding time to the clock in response to the identification of words within the puzzle grid by the player;

rearranging the electronic puzzle grid if the clock has reached the amount of time;

displaying the rearranged electronic puzzle grid to the player; and resetting the clock in response to the rearranging of the puzzle grid.

25. The method as recited in claim 24, further comprising marking the identified words within the rearranged electronic puzzle grid.

26. The method as recited in claim 24, wherein the step of generating the puzzle grid comprises:

(a) selecting a word from the list of puzzle words;

(b) placing the word randomly in the puzzle grid;

(c) selecting a subsequent word from the list of puzzle words;

(d) determining if a portion of the subsequent word overlaps a portion of any word within the puzzle grid;

(e) placing the subsequent word in the puzzle grid if the subsequent word overlaps any word within the puzzle grid;

(f) skipping the subsequent word in the list of puzzle words if the subsequent word does not overlap any word within the puzzle grid; and (g) repeating steps (a) through (f) until all words in the list of puzzle words are placed in the puzzle grid.

27. The method as recited in claim 26, further comprising filling any empty spaces within the puzzle grid with random letters after all words in the list of puzzle words have been placed in the puzzle grid.

28. The method as recited in claim 26, wherein the words are randomly selected from the list of puzzle words.

29. The method as recited in claim 26, wherein the step of rearranging the electronic puzzle comprises repeating steps (a) through (f) of generating the electronic puzzle until all words are placed in the puzzle grid.

30. The method as recited in claim 24, wherein the words identified within the puzzle grid by the player remain marked within the puzzle grid and the list after the puzzle grid is rearranged.

31. The method as recited in claim 24, further comprising prompting a player to select a skill level for the interactive puzzle game.

32. The method as recited in claim 31, further comprising setting the amount of time to different values depending upon the skill level selected by the player.

33. The method as recited in claim 32, further comprising adding different amounts of time to the clock depending on the skill level selected by the player if a word in the list is identified by the player within the puzzle grid.

34. The method as recited in claim 24, further comprising:

displaying the clock to the player; and changing colors of the clock in response to the amount of time remaining.

35. The method as recited in claim 24, further comprising hiding the electronic puzzle in response to an indication by the player to pause the game.

36. The method as recited in claim 24, further comprising marking all the words within the puzzle grid in response to an indication by the player to solve the puzzle.

37. The method as recited in claim 24, further comprising keeping track of the number of times the puzzle grid is rearranged.

38. The method as recited in claim 24, further comprising keeping track of the overall time the interactive puzzle game is played.

39. An interactive puzzle game comprising:

a player interface module;

a clock module that sets a specific amount of time;

a player monitoring module connected to the player interface module and operable to detect actions of the player;

a puzzle module that generates an electronic puzzle; and a display module connected to the player interface and operable to display the electronic puzzle to the player, the puzzle module further rearranging the electronic puzzle if the player has not performed a specific action as detected by the player monitoring module and if the clock module has reached the specific amount of time.

40. The interactive puzzle game as recited in claim 39, further comprising:

a database connected to the player interface module and containing a plurality of puzzles that are selectable by the player, the puzzle module generating an electronic puzzle that corresponds to the puzzle selected by the player.

41. The interactive puzzle game as recited in claim 39, wherein the electronic puzzle is a puzzle grid containing letters.

42. The interactive puzzle game as recited in claim 41, wherein the specific action detected by the player monitoring module is the identification of words within the puzzle grid by the player.

43. The interactive puzzle game as recited in claim 42, wherein the display module displays a separate list containing the words within the puzzle grid which are to be identified by the player.

44. The interactive puzzle game as recited in claim 43, wherein the player interface module is operable to interact with the puzzle grid such that the player can select letters within the puzzle grid, and the player monitoring module is operable to set an anchor on a letter selected by the player within the puzzle grid and highlight additional letters within the puzzle grid in response to the selection of those letters by the player.

45. The interactive puzzle game as recited in claim 44, wherein the player monitoring module is further operable to mark the word corresponding to the highlighted letters within the puzzle grid and the list displayed to the player if the letters selected by the player within the puzzle grid correspond to a word in the list.

46. The interactive puzzle game as recited in claim 45, wherein the display module is further operable to display a clock to the player, wherein the clock is restarted in response to the rearranging of the puzzle grid.

47. The interactive puzzle game as recited in claim 45, wherein the words identified within the puzzle grid by the player remain marked within the puzzle grid and the list after the puzzle grid is rearranged.

48. The interactive puzzle game as recited in claim 42, wherein the display module is further operable to display a clock to the player, wherein time is added to the clock in response to the identification of words within the puzzle grid by the player.

49. The interactive puzzle game as recited in claim 39, further comprising a skill level selector module connected to the player interface module.

50. The interactive puzzle game as recited in claim 49, wherein different amounts of time are added to the clock depending upon the skill level selected by the player.

51. The interactive puzzle game as recited in claim 39, wherein the display module is further operable to display a clock to the player, wherein the clock changes colors in response to the amount of time remaining.

52. The interactive puzzle game as recited in claim 41, wherein the puzzle module is operable to:

(a) generate a list of puzzle words;

(b) select a word from the list of puzzle words;

(c) place the word randomly in the puzzle grid;

(d) select a subsequent word from the list of puzzle words;

(e) determine if a portion of the subsequent word overlaps a portion of any word within the puzzle grid;

(f) place the subsequent word in the puzzle grid if the subsequent word overlaps any word within the puzzle grid; and (g) skip the subsequent word in the list of puzzle words if the subsequent word does not overlap any word within the puzzle grid, so as to generate the electronic puzzle.

53. The interactive puzzle game as recited in claim 52, wherein the puzzle module is further operable to repeat operations (d) through (g) until all words in the list of puzzle words are placed in the puzzle grid.

54. The interactive puzzle game as recited in claim 53, wherein the puzzle module is further operable to implement operations (b) through (g) until all words are placed in the puzzle grid so as to regenerate the electronic puzzle.

55. An interactive puzzle game comprising:

a processor; and a memory connected to the processor and storing a plurality of puzzles, each puzzle containing a list of words to be identified by a player, the processor operable with the memory to:

generate an electronic puzzle grid containing the words from the list of words;

display the list of words to be identified and the electronic puzzle grid to the player;

establish an amount of time;

start a clock;

prompt a player to find the words in the list within the puzzle grid;

set an anchor in response to the selection of a letter within the puzzle grid by the player;

highlight additional letters within the puzzle grid in response to the selection of those letters by the player;

mark the word corresponding to the highlighted letters within the puzzle grid if the letters selected by the player identify a word within the list;

mark the word in the list which corresponds to the word marked within the puzzle grid to indicate that the word has been identified by the player;

add time to the clock in response to the identification of words within the puzzle grid by the player;

rearrange the electronic puzzle grid if the clock has reached the amount of time;

display the rearranged electronic puzzle grid to the player; and reset the clock in response to the rearranging of the puzzle grid.

56. The interactive puzzle game as recited in claim 55, wherein the processor is further operable to:

(a) select a word from the list of puzzle words;

(b) place the word randomly in the puzzle grid;

(c) select a subsequent word from the list of puzzle words;

(d) determine if a portion of the subsequent word overlaps a portion of any word within the puzzle grid;

(e) place the subsequent word in the puzzle grid if the subsequent word overlaps any word within the puzzle grid;

(f) skip the subsequent word in the list of puzzle words if the subsequent word does not overlap any word within the puzzle grid; and (g) implement operations (a) through (f) until all words in the list of puzzle words are placed in the puzzle grid, so as to generate the electronic puzzle grid.

57. The interactive puzzle game as recited in claim 56, wherein the processor is further operable to implement operations (a) through (f) until all words are placed in the puzzle grid so as to regenerate the electronic puzzle grid.

58. The interactive puzzle game as recited in claim 55, wherein the processor is further operable to re-mark any words identified within the puzzle grid by the player in the puzzle grid and the list after the puzzle grid is rearranged.

59. The interactive puzzle game as recited in claim 55, wherein the processor is further operable to receive a skill level selection from the player.

60. The interactive puzzle game as recited in claim 59, wherein the amount of time established is a different value depending upon the skill level selection.

61. The interactive puzzle game as recited in claim 60, wherein different amounts of time are added to the clock depending on the skill level selection.

62. The interactive puzzle game as recited in claim 55, wherein the processor is further operable to:

display the clock to the player; and change a color of the clock in response to the amount of time remaining.

63. The interactive puzzle game as recited in claim 55, wherein the processor is further operable to hide the electronic puzzle in response to receipt of a pause command from the player.

64. The interactive puzzle game as recited in claim 55, wherein the processor is further operable to mark all the words within the puzzle grid in response to receipt of a solve command from the player.

65. The interactive puzzle game as recited in claim 55, wherein the processor is further operable to keep track of the number of times the puzzle grid is rearranged.

66. The interactive puzzle game as recited in claim 55, wherein the processor is further operable to keep track of the overall time the interactive puzzle game is played.

* * * * *